US007328537B2

(12) United States Patent
Hammer

(10) Patent No.: US 7,328,537 B2
(45) **Date of Patent: *Feb. 12, 2008**

(54) WALL BLOCK, SYSTEM AND METHOD

(75) Inventor: James Hammer, University Place, WA (US)

(73) Assignee: Westblock Systems, Inc., Salem, OR (US)

( * ) Notice: Subject to any disclaimer, the term of this patent is extended or adjusted under 35 U.S.C. 154(b) by 605 days.

This patent is subject to a terminal disclaimer.

(21) Appl. No.: 10/273,631

(22) Filed: Oct. 18, 2002

(65) Prior Publication Data

US 2003/0074856 A1 Apr. 24, 2003

Related U.S. Application Data

(60) Provisional application No. 60/344,549, filed on Oct. 18, 2001.

(51) Int. Cl.
*E04C 2/04* (2006.01)

(52) U.S. Cl. ..... 52/604; 52/605; 52/592.5; 52/585.1

(58) Field of Classification Search ..... 52/604, 52/605, 606, 607, 608, 592.5, 585.1, 745.1; 405/284

See application file for complete search history.

(56) References Cited

U.S. PATENT DOCUMENTS

| | | | | | |
|---|---|---|---|---|---|
| 378,356 | A | * | 2/1888 | Cohen | 15/215 |
| 1,727,363 | A | | 9/1929 | Bone | |
| 2,225,612 | A | * | 12/1940 | Allen | 52/586.2 |
| 2,235,646 | A | * | 3/1941 | Schaffer | 52/585.1 |
| 2,963,828 | A | | 12/1960 | Belliveau | |
| 3,036,407 | A | * | 5/1962 | Dixon | 52/585.1 |
| 3,609,926 | A | * | 10/1971 | Muse | 52/439 |
| 3,936,987 | A | | 2/1976 | Calvin | |
| 4,016,693 | A | | 4/1977 | Warren | |
| 4,110,949 | A | | 9/1978 | Cambiuzzi et al. | |
| 4,228,628 | A | | 10/1980 | Schlomann | |
| 4,524,551 | A | | 6/1985 | Scheiwiller | |
| 5,161,918 | A | * | 11/1992 | Hodel | 405/286 |
| RE34,314 | E | | 7/1993 | Forsberg | |

(Continued)

FOREIGN PATENT DOCUMENTS

| | | |
|---|---|---|
| AT | 4473 | 7/2001 |

(Continued)

*Primary Examiner*—Basil Katcheves
(74) *Attorney, Agent, or Firm*—Klarquist Sparkman, LLP

(57) ABSTRACT

A wall block includes an upper surface spaced apart from a substantially parallel lower surface, opposed first and second faces, and opposed side surfaces converging between respective ends of the first and second faces. Blocks in a wall may be stacked on top of each other in either a vertical, set forward or set backward relationship. The length of a block face may be a multiple of its height, and the blocks otherwise are formed such that blocks may be stacked with the top surface of one block in abutment with a bottom surface of a vertically adjacent block or, optionally, with the top or bottom surface of one block in abutment with a side surface of a vertically adjacent block. The blocks may be manufactured in different sizes, such that their faces are of different lengths and heights, thereby enabling the construction of walls or fences of highly variable appearances.

23 Claims, 12 Drawing Sheets

U.S. PATENT DOCUMENTS

| | | | | | |
|---|---|---|---|---|---|
| 5,257,880 | A | * | 11/1993 | Janopaul, Jr. | 405/284 |
| 5,417,523 | A | * | 5/1995 | Scales | 405/284 |
| 5,537,796 | A | | 7/1996 | Kliethermes, Jr. | |
| 5,540,525 | A | * | 7/1996 | Miller et al. | 405/284 |
| 5,595,460 | A | * | 1/1997 | Miller et al. | 405/284 |
| 5,711,130 | A | | 1/1998 | Shatley | |
| 5,816,749 | A | * | 10/1998 | Bailey, II | 405/286 |
| 5,848,511 | A | | 12/1998 | Scales | |
| 5,858,511 | A | * | 1/1999 | Lisowsky | 428/167 |
| 5,984,589 | A | * | 11/1999 | Ciccarello | 405/284 |
| 6,019,550 | A | * | 2/2000 | Wrigley et al. | 405/262 |
| 6,024,517 | A | * | 2/2000 | Castonguay et al. | 405/286 |
| 6,035,599 | A | * | 3/2000 | Sonnentag | 52/604 |
| 6,115,983 | A | * | 9/2000 | Poignard | 52/606 |
| 6,149,352 | A | | 11/2000 | MacDonald | |
| 6,615,561 | B2 | * | 9/2003 | MacDonald et al. | 52/606 |
| 6,827,527 | B2 | * | 12/2004 | Conkel et al. | 405/284 |
| 6,854,231 | B2 | * | 2/2005 | MacDonald et al. | 52/562 |
| 6,893,192 | B2 | * | 5/2005 | MacDonald | 405/284 |
| 6,912,823 | B2 | * | 7/2005 | MacDonald et al. | 52/574 |
| 6,960,048 | B2 | * | 11/2005 | Blomquist et al. | 405/284 |
| 2002/0001509 | A1 | * | 1/2002 | Hong | 405/286 |
| 2002/0083657 | A1 | * | 7/2002 | Mattox et al. | 52/125.2 |
| 2003/0002925 | A1 | * | 1/2003 | Blomquist et al. | 405/284 |
| 2003/0070383 | A1 | * | 4/2003 | Heinle | 52/582.1 |

FOREIGN PATENT DOCUMENTS

| | | |
|---|---|---|
| EP | 0 170 113 A1 | 7/1985 |
| FR | 2.216.823 | 8/1974 |
| GB | 2 127 872 A | 4/1984 |
| WO | WO 01/57333 | 8/2001 |

* cited by examiner

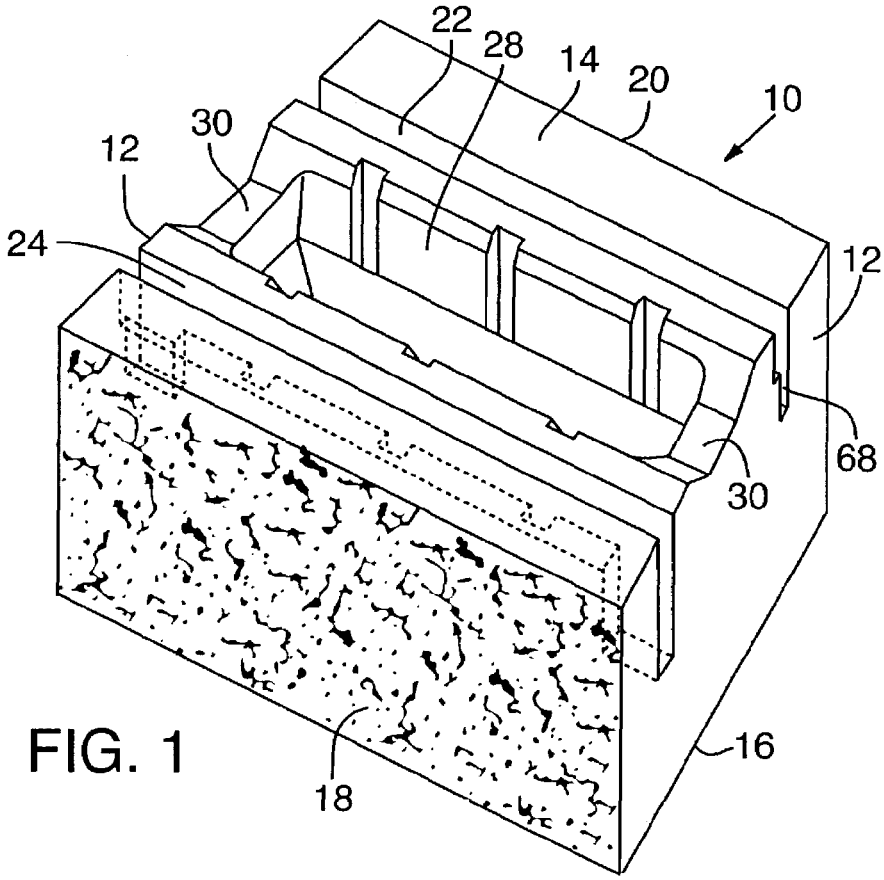
FIG. 1
FIG. 2
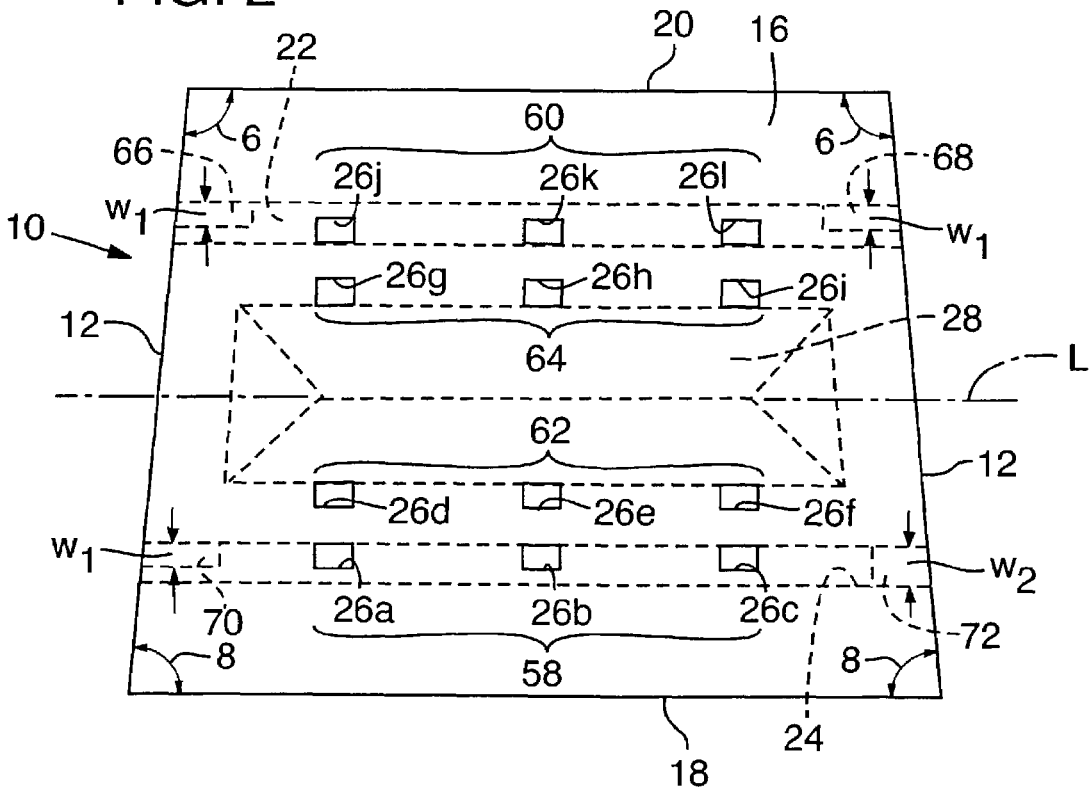

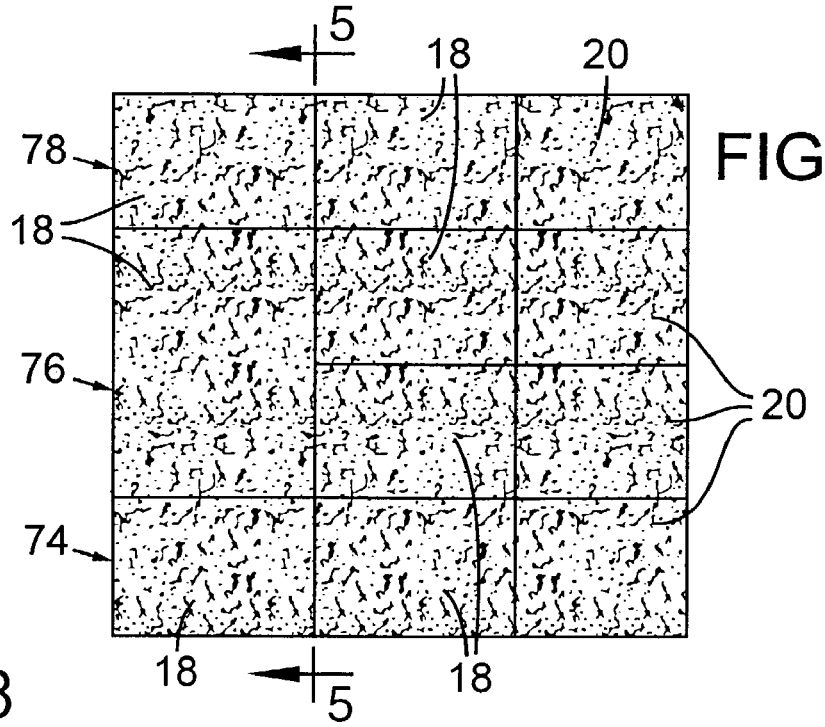
FIG. 4
FIG. 8
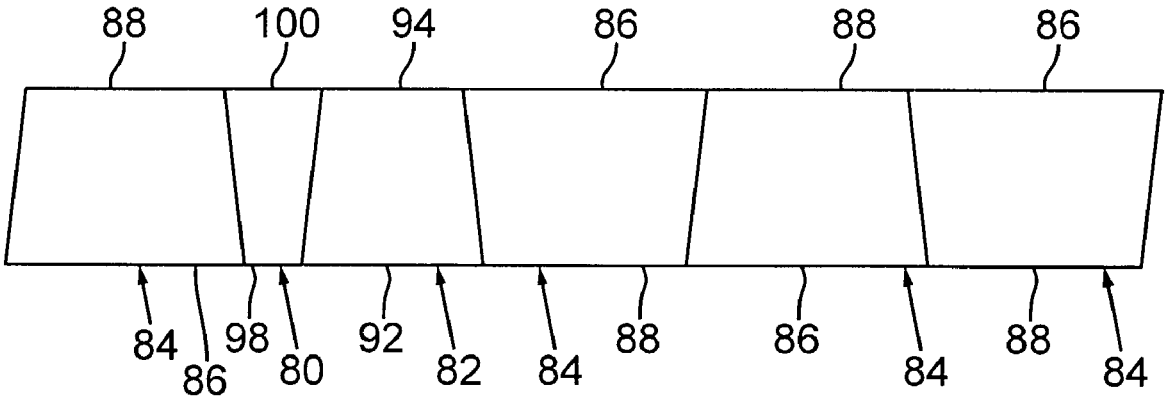
FIG. 9
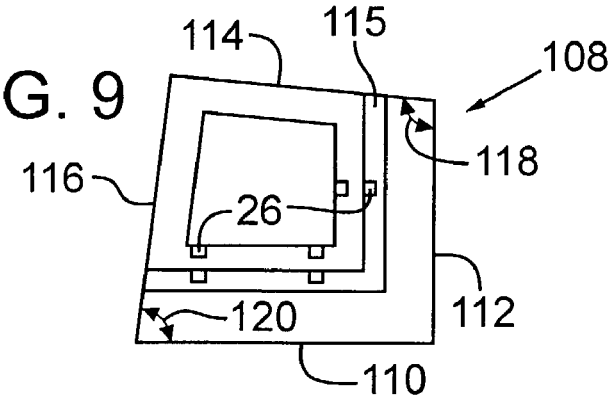

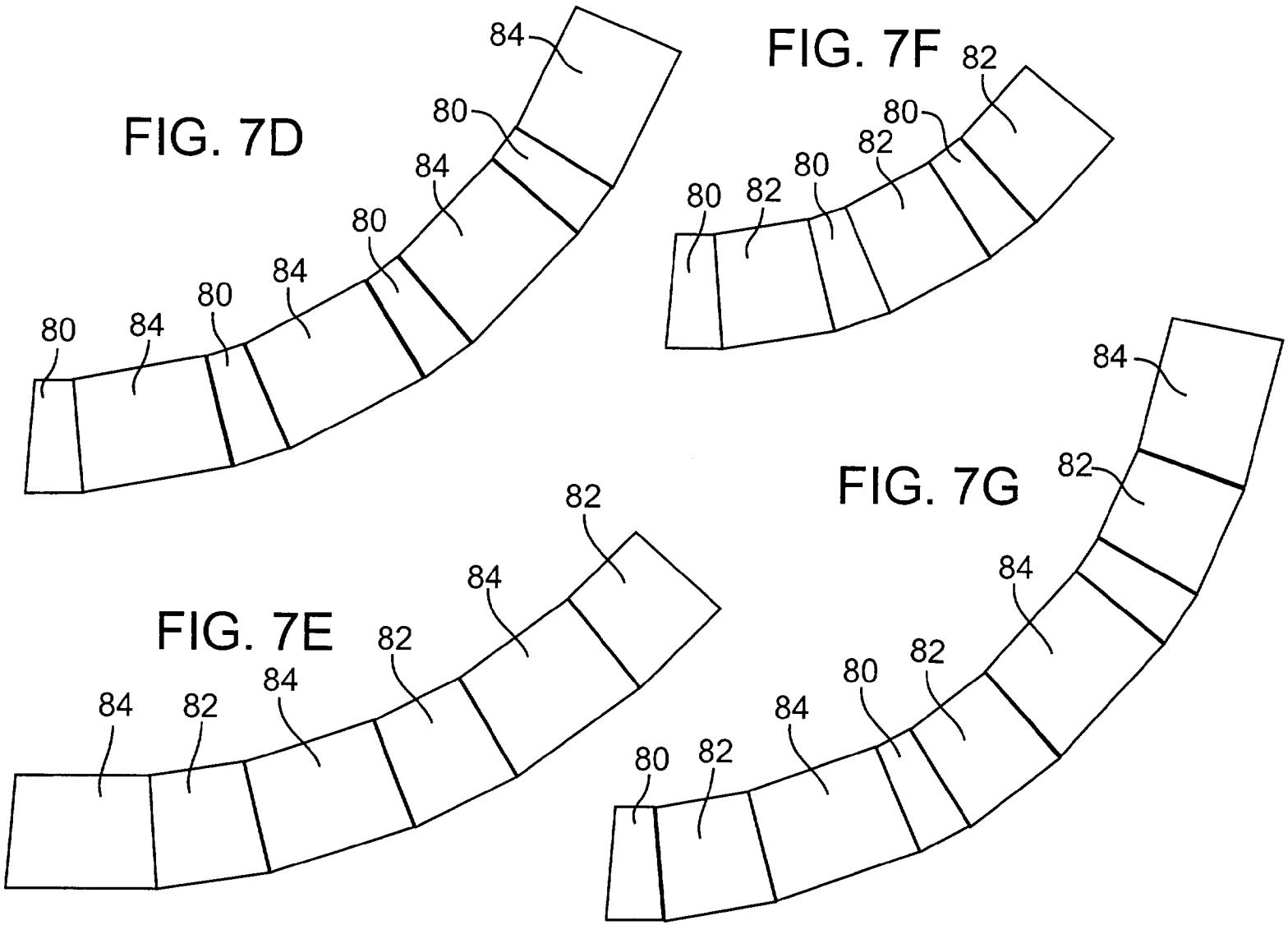
84
80
84
80
84
80
84
80
82
80
82
80
82
80
84
82
84
82
84
82

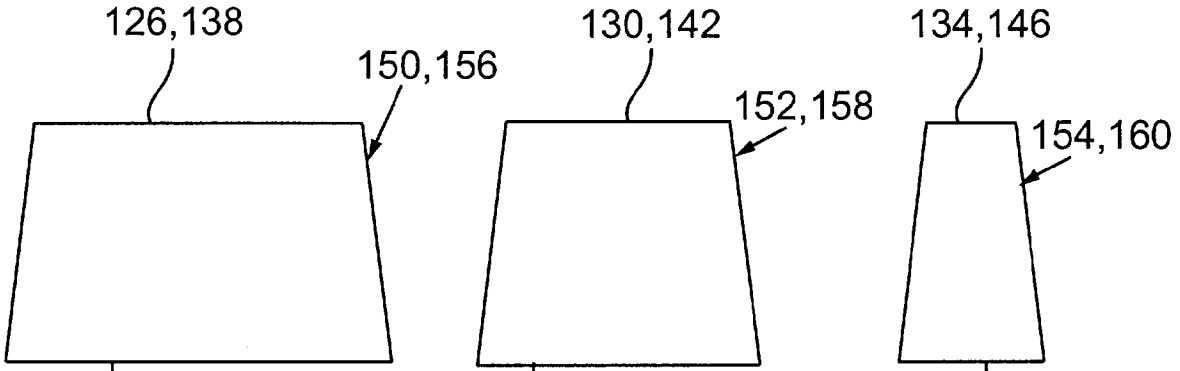
FIG. 12A
FIG. 12B
FIG. 12C
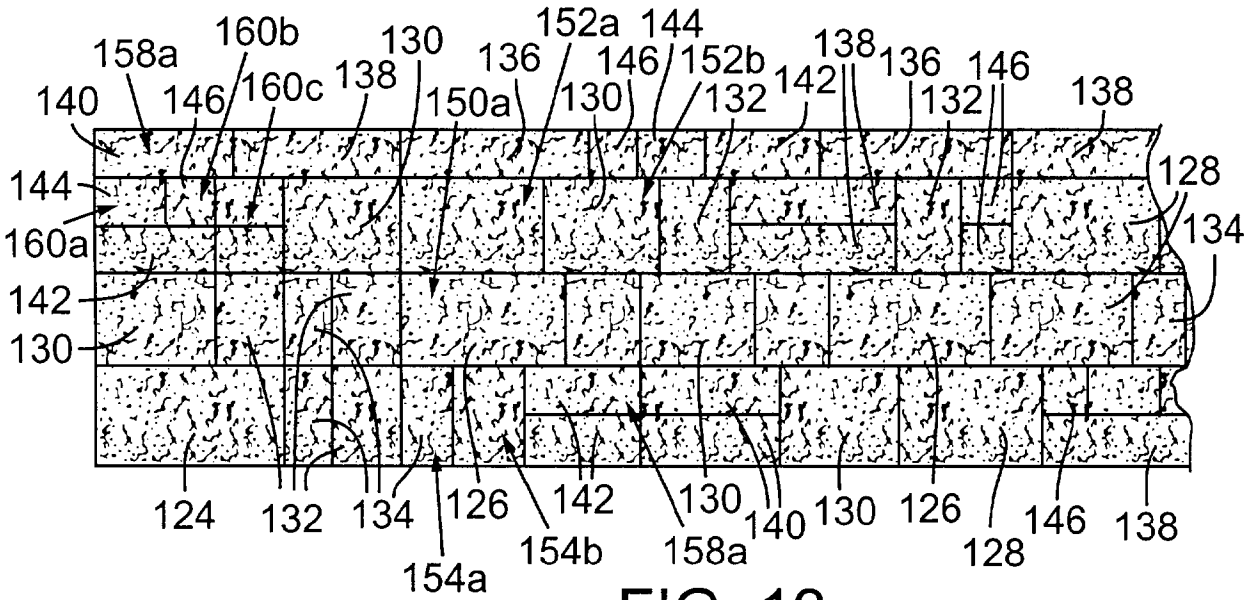
FIG. 13

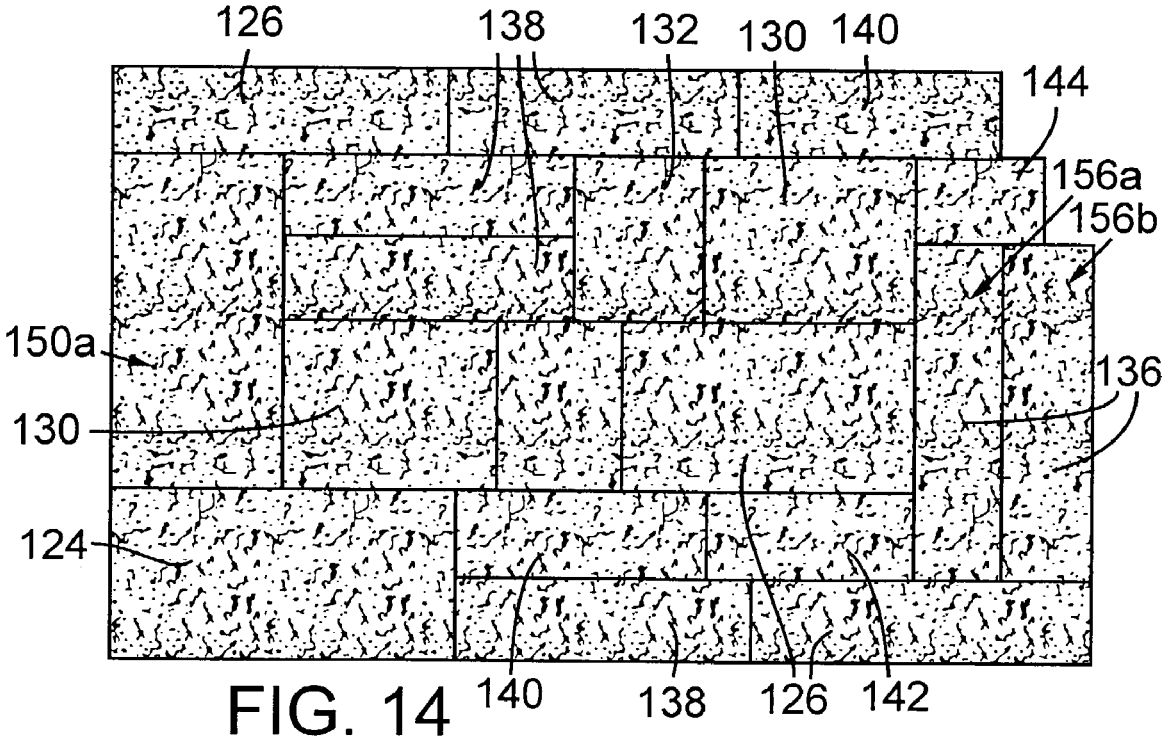
FIG. 14
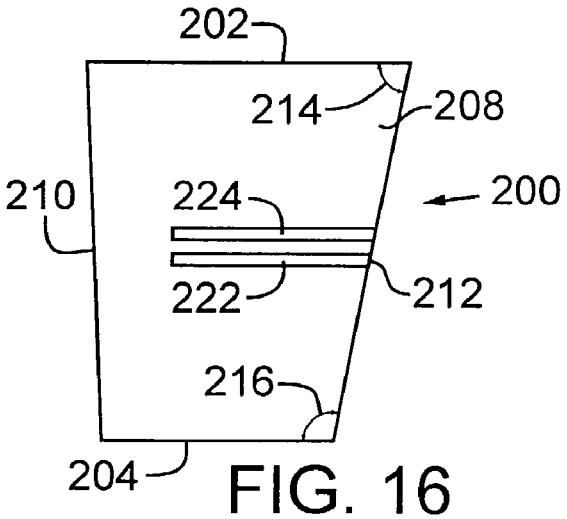
FIG. 16
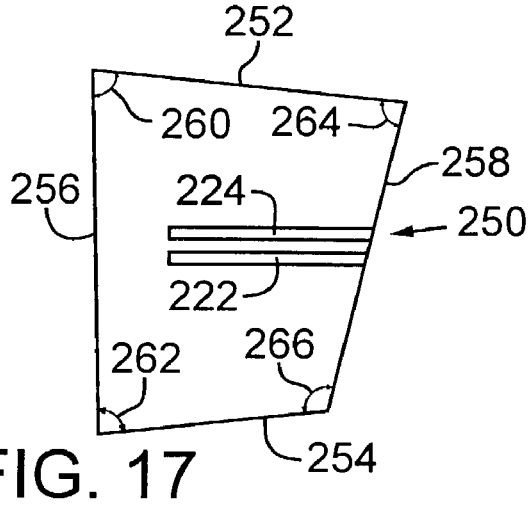
FIG. 17
FIG. 20
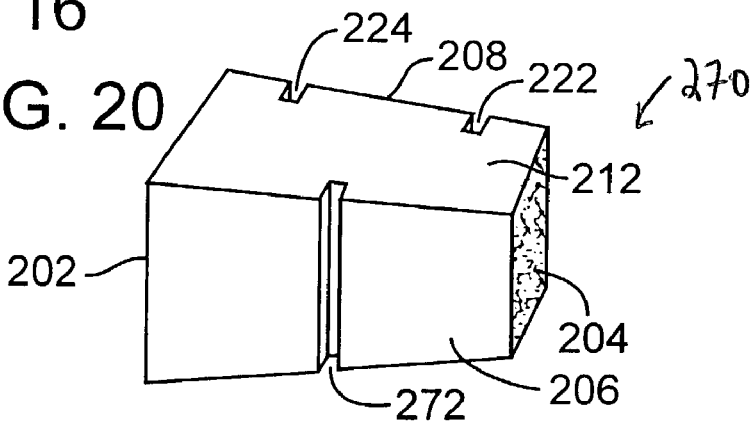

WALL BLOCK, SYSTEM AND METHOD

CROSS-REFERENCE TO RELATED APPLICATION

This application claims priority to U.S. Provisional Application No. 60/344,549, filed Oct. 18, 2001.

FIELD

The present invention relates to blocks, such as concrete blocks, for constructing walls, and more particularly to blocks employing a pin and slot system for interconnecting blocks stacked on top of each other in a wall.

BACKGROUND

Natural stone blocks cut from quarries have been used for a number of years to assemble walls of various types, including ornamental walls for landscaping purposes. Natural blocks have unique sizes, differences in shape and differences in appearance. However, construction of walls using such blocks requires significant skill to match, align, and place blocks so that the wall is erected with substantially uniform courses. While such walls provide an attractive ornamental appearance, the cost of quarried stone and the labor to assemble the stone blocks are generally cost prohibitive for most applications.

An attractive, low cost alternative to natural stone blocks are molded concrete blocks. In fact, there are several, perhaps hundreds, of utility and design patents which relate to molded blocks and/or retaining walls made from such blocks. Most prior art walls, however, are constructed from dimensionally identical blocks which can only be positioned in one orientation within the wall. Thus, a wall made from molded or cast blocks does not have the same random and natural appearance of a wall made from natural stone blocks.

Accordingly, there is a need for new and improved molded blocks and block systems and methods for constructing walls that have a more natural appearance than walls constructed using molded blocks, block systems, and molded block methods of the prior art.

SUMMARY

According to one embodiment, a block for constructing retaining walls comprises an upper surface spaced apart from a substantially parallel lower surface, opposed first and second faces, and opposed side surfaces extending between respective ends of the first and second faces, which together form a block body. A first pin-receiving recess is formed in the upper surface of the block. A first, longitudinally extending pin-receiving channel is formed in the lower surface of the block. The channel also intersects the side surfaces and extends continuously therebetween.

Desirably, the first face has a surface area greater than that of the second face. In a disclosed embodiment, the side surfaces taper inwardly from the first face to the second face. In another disclosed embodiment, only one of the side surfaces tapers inwardly from the first face to the second face and the other side surface is substantially perpendicular to the first and second faces. In both embodiments, the block is "reversible," that is, either the first face or the second face can serve as the exposed face in one side of a wall, thereby giving the appearance that the wall is constructed from two differently sized blocks.

The pin-receiving recess in the upper surface may comprise either a pin hole or an elongate slot extending substantially parallel to the first and second faces. In either case, when constructing a wall, a pin may be inserted into the pin-receiving recess in the upper surface of the block. The exposed, upper portion of the pin can then be inserted into the pin-receiving channel in the lower surface of an overlying block. The channel permits a block to be shifted longitudinally in a course so that it is longitudinally offset from a block in an adjacent lower course.

The block also can be configured to permit placement of the block in a vertical orientation in a wall, as a jumper block. When used in this manner, the side surfaces serve as the upper and lower surfaces of the block in a wall and the upper and lower surfaces serve as the side surfaces of the block in a wall. Thus, a combination of both horizontally and vertically oriented blocks can be used to construct a wall. In blocks configured for use as a jumper, the first face of the block desirably has a length that is a multiple of the height of the block so that it is possible to achieve a level upper surface of the wall.

According to another embodiment, a block for constructing retaining walls comprises an upper surface spaced apart from a substantially parallel lower surface, opposed first and second faces, and opposed side surfaces extending between respective ends of the first and second faces. At least one pin-receiving aperture or pin hole is formed in the upper surface of the block. First and second longitudinally extending pin-receiving channels are formed in the lower surface. The channels extend at least partially between the side surfaces of the block. To interconnect a lower block with an overlying block in an adjacent upper course, the lower portion of a pin may be inserted into the pin-receiving aperture of the lower block the upper portion of the pin may be inserted in either of the first or second channels in the lower surface of the overlying block.

The block may further include first, second, third and fourth rows of pin holes in the upper surface. Each row extends longitudinally of the block and has at least one pin hole. The first and third rows of pin holes are spaced from the first and second faces, respectively, by a first distance. The second and fourth rows of pin holes are spaced from the first and second faces, respectively, by a second distance less than the first distance. The first and third rows of pin holes desirably are vertically aligned with the first and second channels, respectively, in the upper surface. In this manner, like blocks can be stacked directly over one another to form a vertical wall with a connecting pin being partially received in, for example, a pin hole of the first row of a lower block and the first channel of an overlying block. The pin and slot system also permits the interconnection of blocks stacked in a set forward or set backward manner.

In addition, the pin holes of the first row may be positioned so as to be tangent to or contacting a vertical plane defined by the first channel. Likewise, the pin holes of the third row may be positioned so as to be tangent to a vertical plane defined by the second channel. Thus, where an overlying block is stacked in vertically alignment with an adjacent lower block, the head of the connecting pin will abut a side surface in its respective channel in the overlying block to prevent retained earth from upsetting the vertical alignment of the blocks.

According to yet another embodiment, a block for constructing retaining walls comprises an upper surface spaced apart from a substantially parallel lower surface, opposed first and second faces, and opposed side surfaces extending between respective ends of the first and second faces. At least one pin hole is formed in the upper surface and at least one longitudinally extending trough is formed in the lower surface. The pin hole desirably is positioned tangent to a vertical plane defined by a side surface of the trough.

In another embodiment, a block system for constructing walls comprises a first and second set of blocks. The first set of blocks comprises a small, medium and large block, each of which has an upper surface spaced apart from a substantially parallel lower surface defining a block height, opposed first and second faces, and opposed side surfaces extending between respective ends of the first and second faces. The second set of blocks comprises a small, medium and large block, each of which has an upper surface spaced apart from a substantially parallel lower surface defining a block height, opposed first and second faces, and opposed side surfaces extending between respective ends of the first and second faces.

Within each set, the blocks have the same height and the same depth. In addition, the dimensions of the small, medium and large block of the first set desirably are equal to the dimensions of the small, medium and large block, respectively, of the second set, except that the blocks of the second set are greater in height than the blocks of the first set. In a disclosed embodiment, the height of the blocks of the second set is a multiple of the height of the blocks of the first set.

A method according to one embodiment of constructing a wall also is provided. The method includes providing a first block having a first face with a surface area greater than the surface area of an opposed second face. The first block is positioned in a first course with its lower surface facing the ground. A second block has a first face with a surface area greater than the surface area of an opposed second face. The second block is positioned in a second course on top of the first course in a vertical position so that a side surface of the second block is juxtaposed to the upper surface of the first block.

The foregoing and other objects, features, and advantages of the invention will become more apparent from the following detailed description of several embodiments, which proceeds with reference to the accompanying figures.

BRIEF DESCRIPTION OF THE DRAWINGS

FIG. 1 is a bottom perspective view of a wall block according to one embodiment of my invention.

FIG. 2 is a top plan view of the block of FIG. 1.

FIG. 4 is a front elevational view of a wall constructed from like blocks having the configuration of the block of FIGS. 1 and 2 wherein one such block is positioned in a vertical orientation as a jumper.

FIGS. 7A-7G are top plan views of various curvilinear walls that may be constructed from one or more of the sizes of blocks of the three-block system of FIG. 6.

FIG. 8 is a top plan view of a straight wall constructed from the three-block system of FIG. 6.

FIG. 9 is a top plan view of a corner block according to another embodiment of my invention for forming 90° corners.

FIGS. 12A-12C illustrate, in top plan view, a block system comprising a first set of small, medium and large blocks of a first height and a second set of small, medium and large blocks of a second height.

FIG. 13 is a front elevational view of a wall constructed from various blocks of the block system depicted in FIGS. 12A-12C.

FIG. 14 is a front elevational view of another wall constructed from various blocks of the block system depicted in FIGS. 12A-12C, showing a large block of the first set and a large block of the second set being used as jumper blocks.

FIG. 16 is a bottom plan view of the block shown in FIGS. 15A and 15B.

FIG. 17 is a bottom plan view of the bottom surface of a block according to another embodiment of my invention.

FIG. 20 is a perspective view of a block according to another embodiment, as viewed from above, showing one side surface and the top surface.

DETAILED DESCRIPTION

Figure 3:
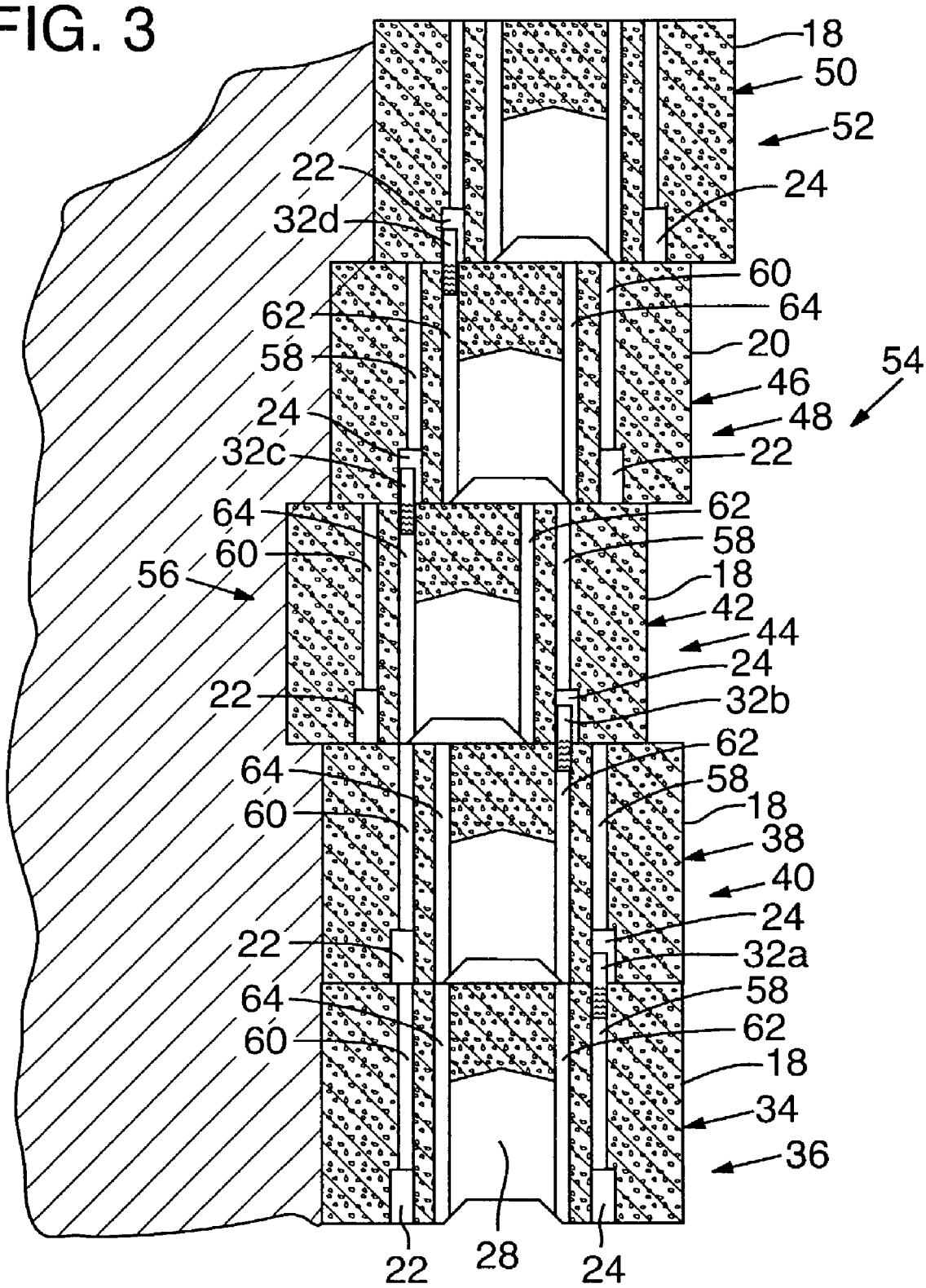
FIG. 3 is a vertical sectional view of a wall, from front to back, constructed from like blocks having the configuration of the block of FIGS. 1 and 2

In the following description, "upper" and "lower" refer to the placement of a block in a retaining wall. The lower, or bottom, surface of a block is placed such that it faces the ground. In a retaining wall, one row of blocks is laid down, forming a lowermost course or tier. An upper course or tier is formed on top of this lower course by positioning the lower surface of one block on the upper surface of another block. Additional course may be added until a desired height of the wall is achieved. Typically, earth is retained behind a retaining wall so that only a front surface of the wall is exposed. A free-standing wall (i.e., one which does not serve to retain earth) having two exposed surfaces may be referred to as a "fence."

According to a first aspect, a block for constructing a wall is configured to be reversible, that is, the block has at least two surfaces of different dimensions, each of which can be used as the exposed face in a surface of a wall. According to another aspect, a pin and slot connection system for interconnecting blocks of adjacent courses permits alignment of blocks directly over one another, set forward, or set backward relative to one another so that either vertical or non-vertical walls may be constructed.

Referring first to FIGS. 1 and 2, there is shown a block 10 according to one representative embodiment. FIG. 1 is a bottom perspective view of the block 10, and FIG. 2 is a top plan view of the block 10. The block 10 comprises opposed side walls or side surfaces 12, generally parallel bottom and top surfaces 14, 16, respectively, and generally parallel first and second faces 18, 20, respectively. The side walls 12 taper inwardly, or converge, as they extend from the first face 18 to the second face 20 so that acute angles 8 are formed between the first face 18 and side walls 12 and obtuse angles 6 are formed between the second face 20 and side walls 12. Hence, the surface area of the first face 18 is greater than the surface area of the second face 20.

Desirably, the surface texture of the first face 18 is the same as that for the second face 20. In this manner, the block 10 is "reversible," that is, either the first face 18 or the second face 20 can serve as the exposed face on one side of a wall. Since the first face 18 is larger than the second face 20, a wall constructed from such blocks takes on a more random, natural appearance, than a wall in which the exposed faces of all blocks are equal in size. In the illustrated embodiment, for example, both the first face 18 and the second face 20 are provided with a roughened, split look (as shown in FIG. 1) to contribute to the natural appearance of the wall. The block also may be "tumbled" to round the edges and corners of the block, as generally known in the art. Alternatively, the block 10 may be molded so that either of faces 18, 20 has a smooth, rather than a rough, surface.

Figure 5:
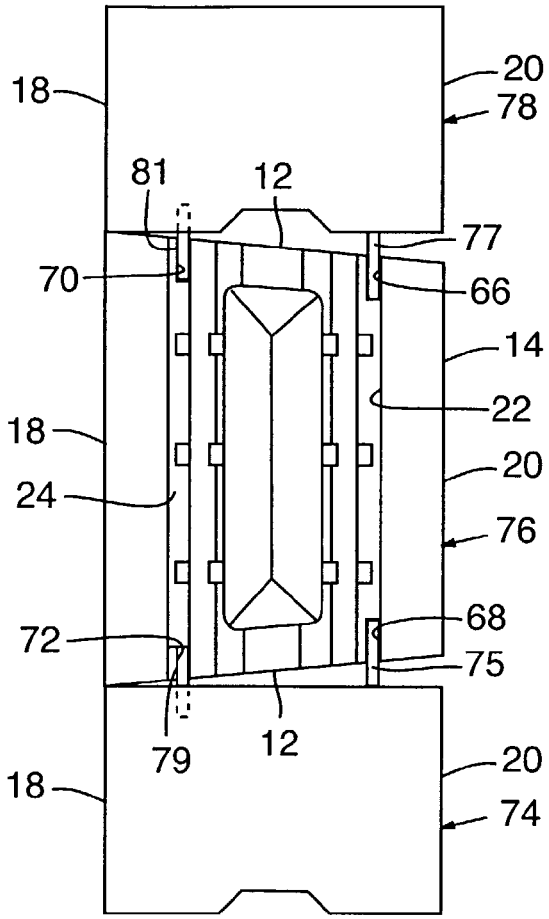
FIG. 5 is a vertical sectional view of the wall of FIG. 4 taken along line 5-5 of FIG. 4.

Pin-receiving slots (also referred to herein as troughs or channels) 22, 24 formed in the bottom surface 14 extend longitudinally of the block between the side walls 12, and preferably intersect the side walls as shown. The slots 22, 24 allow a block to be shifted longitudinally in a course either to the left or the right so that the block is longitudinally offset from a block in an adjacent lower course. Thus, a block in an upper course can be positioned to span two blocks in a lower course and be connected to them with a connected pin extending into one of the slots from one or both of the blocks in the lower course. Although less desirable, either of slots 22, 24 may extend only partially between the side walls 12. For example, the length of the slots 22, 24 may be less than the distances between opposed side walls at the slots such that the slots do not intersect the side walls 12. This configuration, however, limits the longitudinal placement of a block in an upper course relative to the blocks of a lower course. It would also eliminate the ability of a block to be stacked on its side in a wall, as shown in FIG. 5.

The block 10 may also have a centrally located core 28 between the channels 22, 24 to reduce the overall weight of the block 10. The core 28 in the illustrated example is a semi-hollow or partial core that extends from the bottom surface 14 partially through the block 10. The core 28 may be a full core, that is, a core that extends completely through the block 10. When forming courses with blocks having full cores, the cores should be filled with a fill material, such as gravel, to prevent migration of earth into the core. In addition, the block 10 may have optional hand holds or handles 30 defined in the bottom surface 14 at each side wall 12 to facilitate carrying or placement of the block 10.

The block 10 has a plurality of pin-receiving apertures such as pin holes 26*a-l* formed in the upper surface 16. The pin holes 26*a-l* are shown as extending completely through the block, although this is not a requirement. In an alternative embodiment, the pin holes 26*a-l* extend partially through the block from the upper surface. In any event, the pin holes 26*a-l* are arranged in four rows extending substantially parallel to the first and second faces 18, 20.

Each row in the illustrated embodiment has three such pin holes 26, although the number of pins holes 26 in each row, as well as the number of rows of pin holes 26, may vary.

As best shown in FIG. 2, pins holes 26*a*, 26*b* and 26*c* comprise an outer row 58 of pin holes which are vertically aligned with the channel 24. Pin holes 26*j*, 26*k* and 26*l* comprise an outer row 60 of pin holes which are vertically aligned with the channel 22. Desirably, pin holes 26*a*, 26*b*, 26*c* and 26*j*, 26*k*, 26*l* are positioned so as to have one side tangent to the inner wall of a respective channel 24, 22. This, as explained in greater detail below, prevents earth retained behind the wall, which exerts forward pressure on the wall, from upsetting the vertical alignment of the blocks in the wall. The outer rows 58, 60 of pin holes are equally spaced a predetermined first distance from a longitudinal axis, or plane, L extending through the block halfway between the first and second faces 18, 20 that is, plane L bisects the block between its faces. Pin holes 26*d*, 26*e* and 26*f* comprise an inner row 62 of pin holes between the outer row 58 and the core 28. Pin holes 26*g*, 26*h* and 26*i* comprise an inner row 64 of pin holes between the outer row 60 and the core 28. The inner rows 62, 64 are equally spaced from the longitudinal axis or plane L a predetermined second distance that is less than the first distance.

FIG. 3 illustrates a vertical cross-sectional, side elevational view of a wall made from a plurality of blocks having the same general shape as block 10 shown in FIGS. 1-2. The wall has a front, exposed surface 54 and a second surface 56, behind which earth may be retained. Of course, if the wall is a freestanding wall, then both the first and second surfaces 54, 56 are exposed. The first, lowermost course 36 of such a wall typically is laid in a trench (not shown) and successive courses 40, 44, 48 and 52 are laid one on top of the other. Either the first or second face 18, 20 of any one block may be used to form the front surface 54 of the wall. Pins 32 are used to hold the courses of blocks in place, although in some applications, such as where a wall is relatively short in height, the weight of the blocks may be sufficient to hold the blocks in place without the use of pins. The lower portion of such a pin 32 is received in any one of pin holes 26 in the upper surface 16 of a block. The upper portion, or head, of the pin 32 is positioned in one of the slots 22, 24 of an overlying block.

When constructing engineered or structural walls (e.g., walls typically built above a height of about four feet), a suitable geogrid can be placed between courses of blocks to extend into the hillside or earth behind the wall to give the wall sufficient strength and stability. Blocks having full cores (i.e., a core extending completely through the block) are preferred (although not required) when using geogrid because the fill material placed in the cores assists in retaining the geogrid between adjacent courses.

As mentioned, the pin and slot connection system permits vertical, set forward, or set back placement of blocks in a course relative to the blocks in an adjacent lower course. As shown in FIG. 3, the block 38 in the second course 36 is vertically aligned with the block 34 in the first, lowermost course 36. The lower portion of a pin 32*a* in this illustration is positioned in a pin hole 26 of the outer row 58 of block 34. The head of pin 32*a* is positioned in the slot 24 of block 38 so as to contact an inner surface of the slot 24. This contact between the head of the pin and the inner surface of the slot resists any forward movement of block 38 caused by the pressure of earth retained behind the wall so as to maintain the desired vertical alignment of block 38 with respect to block 34. To ensure that the wall is sufficiently stable, at least one pin is used to interconnect a block of one course with a block of an adjacent lower course (as shown in FIG. 3), although more than one pin may be used for redundancy or for interconnecting a lower block with two overlying blocks.

Block 42 of the third course 44 is in a set back relation to block 38 of the second course 40. In this position, slot 24 of block 42 is aligned over the inner row 62 of pin holes of block 38 with the lower portion of a pin 32*b* received in a pin hole 26 of block 38 and the head of pin 32*b* received in slot 24 of block 42. Block 46 of the fourth course 48 is in a set forward relation to block 42 of the third course 44 with slot 24 of block 46 being aligned over an inner row 64 of pin holes 26 of block 42. Block 46 is also reversed in the wall so that its second face 20 is exposed in the first surface 54 of the wall and its first face 18 is exposed in the second surface 56 of the wall. A pin 32*c* is partially received in a pin hole 26 of block 42 and slot 24 of block 46 to hold these blocks together. Block 50 of the fifth course 52 is in a set forward position with respect to block 46 of the fourth course 48, with slot 22 of block 50 being aligned over an inner row 62 of pin holes 26 of block 46. A pin 32*d* is partially received in a pin hole 26 in the upper surface 16 of block 46 and slot 22 of block 50.

Referring again FIGS. 1 and 2, block 10 may be also configured to be placed in a vertical orientation in a wall, as a jumper block. When used in this way, the side walls 12 serve as the top and bottom of the block in a wall and the bottom surface 14 and the top surface 16 serve as the side walls of the block in a wall. The length of the first face 18 therefore is the effective height of the block when used as a jumper.

Because the side walls 12 are angled with respect to the first and second surfaces 18, 20, the block 10, when used as a jumper, would be tilted slightly from a vertical plane of the wall. Also, a block placed on top of the upwardly facing side wall 12 of the jumper would be supported at an angle. Thus, to support the jumper and any overlying block in a vertically upright position, pin-receiving slots 66 and 68 are formed in the side walls 12 proximate the ends of channel 22. The widths $w_1$ of pin-receiving slots 66 and 68 are desirably, although not necessarily, dimensioned to form a frictional fit with the lower portion of a connecting pin 32. When the block is turned on its side for vertical placement in a wall, pins are inserted into slots 66 and 68, which then support the block and any overlying block in a vertically upright position. Pin-receiving slots 70 and 72 are similarly formed in the side walls 12 proximate the ends of channel 24. Slot 70 serves as a pin hole for frictionally engaging the lower portion of a pin. Slot 72 has a width equal to that of channel 24 and serves as an extension of channel 24 to receive the upper portion of a pin.

Where a block is configured to be used as a jumper (such as shown in FIGS. 1 and 2), the length of the first face 18 desirably evenly by, that is, a multiple of the height of the block. For example, if the length of the first face 18 is twice the height of the block, then a jumper will span two horizontally oriented blocks, or coarses, in the vertical direction. Thus, as explained below with respect to FIG. 4, it is still possible to achieve a level upper surface of the wall.

FIGS. 4 and 5 illustrate the use of block 10 as a jumper. A wall in this illustration includes a first block 74 of a first course, a second block 76 of a second course and a third block 78 of a third course. Blocks 74, 76 and 78 are of the same general shape as block 10 of FIGS. 1 and 2. The second block 76 is turned on its side so that one of its side walls 12 is adjacent the upper surface 16 of the first block 74 and the other is adjacent the lower surface 14 of the third block 78. As shown in FIG. 5, the lower portion of a pin 75 is inserted into slot 68 of the second block 76 and the head of the pin 75 contacts the upper surface 16 of the first block 74 to support the downwardly facing side wall 12 of block 76 (i.e., the side wall 12 serving as the bottom of block 76) at a position above the upper surface 16 of block 74. The exposed portion of the pin 75 (i.e., the portion extending from slot 68) is long enough to support the second block 76 in a vertically upright position. A pin 77 inserted into slot 66 of block 76 supports block 78 in a vertically upright position. Since pin 77 is aligned with channel 22 of block 78, the upper portion of pin 77 should have a thickness or diameter greater than the width of channel 22 to prevent insertion of the pin therein. Alternatively, if pin 77 is a standard sized pin (i.e., a pin having a diameter that is less than the width of channel 22) a small section of pipe, having a diameter larger than the width of the channel 22, can be placed over the upper portion of pin 77 to prevent insertion of pin 77 into channel 22 of block 78. In an alternative embodiment, slot 66 is offset slightly from channel 22 of block 76 towards the first face 20 or second face 18 so that a pin inserted into slot 66 (such as pin 77 in FIG. 5) is not vertically aligned with a channel in an overlying block. The lower portion of a pin 79 is received in a pin hole in the upper surface of block 74 and the upper portion of pin 79 is received in slot 72 of jumper block 76 to connect blocks 74 and 76. The lower portion of a pin 81 is received in slot 70 of block 76 and the upper portion of pin 81 is received in a respective channel 24 in block 78 to connect blocks 76 and 78.

As best shown in FIG. 5, a course may comprise blocks of different effective "heights," thereby further contributing to the random appearance of the wall. In this illustration, the effective height of the jumper block 76 (i.e., the length of the first face 18) is equal to the overall height of two horizontally oriented blocks stacked on top of each other. Because the height of the jumper block 76 is a multiple of the height of the other blocks in the wall, it is possible to achieve a level upper surface of the wall.

Figure 6:
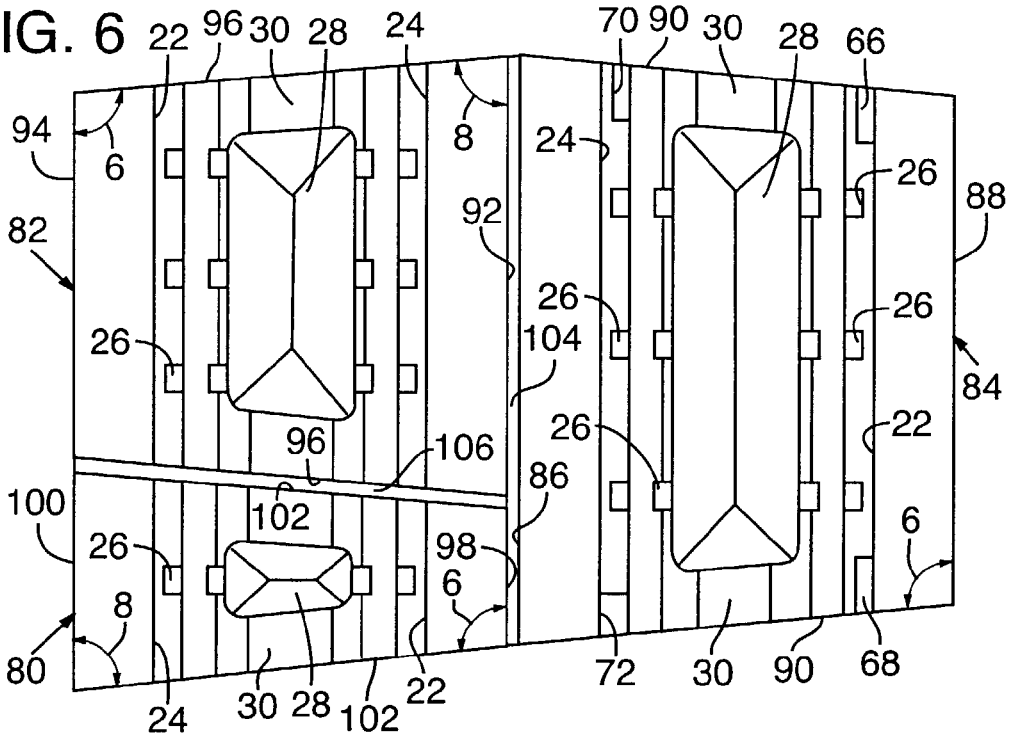
FIG. 6 is a top plan view of a three-block system according to a second embodiment of my invention comprising a small, medium and large block.

FIG. 6 illustrates a block system of three differently sized blocks. The block system includes a first, small block 80, a second, medium block 82 and a third, large block 84. Each block is of the same general shape as the blocks disclosed in FIGS. 1-5. The large block 84 has a first face 86, a second face 88 and converging side walls 90. The medium block 82 has a first face 92, a second face 94 and converging side walls 96. The small block 80 has a first face 100, a second face 98 and converging side walls 102. The surface area of the first face of each block is larger than the surface area of its second face. Desirably, although not necessarily, each block is the same in depth (i.e, the distance from the first face to the second face of a block, for example, between the first face 86 and the second face 88 of the large block 84) and in height (i.e., the distance from the upper surface to the lower surface of a block). The length of the first face 86 of the large block 84 (i.e., the distance the first face 86 extends between side walls 90) desirably is equal to or a multiple of the height of the blocks so that it is possible to achieve a level top surface of a wall when the large block 84 is used as a jumper.

All three blocks may be formed in a single mold as a three-block module, such as shown in FIG. 6. A substantially v-shaped notch 104 defines a groove or split line for bisecting the large block 84 from the small and medium blocks, 80, 82, respectively. These blocks may be split along notch 104 in any conventional manner, such as with a conventional hammer and chisel. Sacrificial portions (not shown) may be molded to faces 88, 94 and 100, which are removed to provide the split look on those faces, as known in the art. During the casting process, a divider plate is positioned between small block 80 and medium block 82 at 106 to provide side wall 102 of block 80 and side wall 96 of block with a smooth surface.

The large block 84 is shown as having all of the features of block 10 shown in FIGS. 1 and 2 and described above. The medium block 82 is similar to the large block 84, except that it does not include the pin-receiving slots 66, 68, 70 and 72 of the large block 84. The small block 80 is shown as having four rows of only one pin hole 26 in each row. The small block 80, like the medium block 82, also does not include the pin-receiving slots 66, 68, 70 and 72 of the large block 84. Thus, in this particular system, only the large block 84 is used as a vertical jumper. However, in other systems, it is contemplated that either the small block or the medium block, or both, are configured to be used as a vertical jumper.

Figures 7A, 7B, 7C:
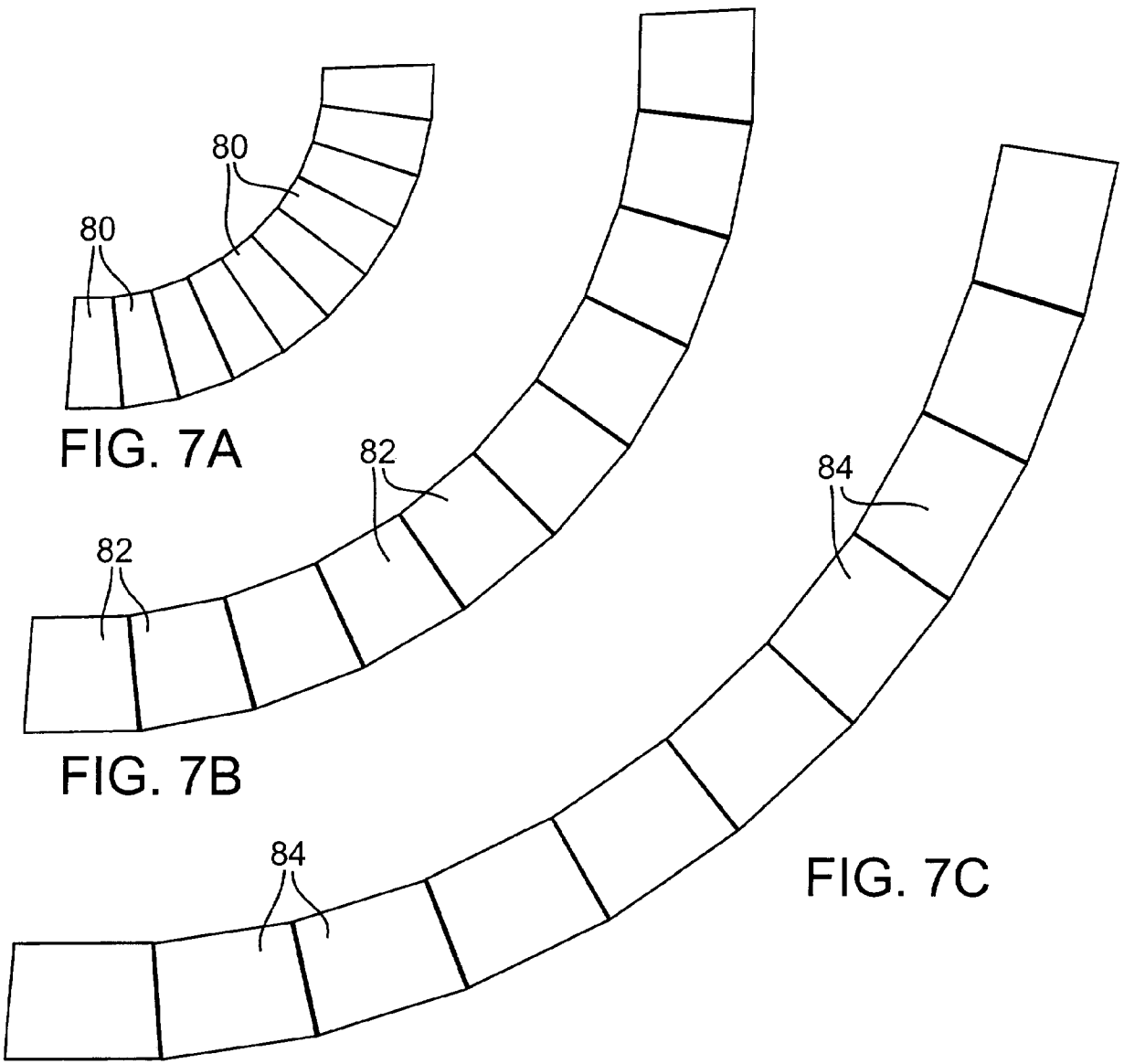

The block system can be used to construct various straight or curvilinear walls. As illustrated in FIGS. 7A-7G, curved walls of various radii can be achieved with the block system. FIG. 7A shows a curved wall constructed from only small blocks 80. FIG. 7B shows a curved wall constructed from only medium blocks 82. FIG. 7C shows a curved wall constructed from only large blocks 84. FIG. 7D shows a curved wall formed by alternating small blocks 80 and large blocks 84. FIG. 7E shows a curved wall formed by alternating medium blocks 82 and large blocks 84. FIG. 7F shows a curved wall formed by alternating small blocks 80 and medium blocks 82. FIG. 7G shows a curved wall formed by repeating sequences of a small block 80, a medium block 84 and a large block 86.

The dimensions of the small, medium and large blocks may vary. In one specific embodiment of a three-block system, the first face 86 of the large block 84 is 16 inches in length and the second face 88 is 14 inches in length. The first and second faces 92, 94, respectively, of the medium block 82 are 12 and 10 inches, respectively, in length. The first and second faces 100, 98, respectively, of the small block 80 are 6 and 4 inches, respectively, in length. The depth of each block is 11.5 inches and the height of each block is 8 inches. The foregoing dimensions have been found to permit ease of handling and withstand the impact forces of the tumbling process. Of course, those skilled in the art will realize, these specific dimensions (as well as other dimensions provided in the present specification) are given to illustrate the invention and not to limit it. These dimensions can be modified as needed in different applications or situations.

The radii of the curved walls shown in FIGS. 7A-7G, when constructed from small, medium and large blocks with the foregoing dimensions, are as follows: 36 inches for FIG. 7A, 69 inches for FIG. 7B, 94 inches for FIG. 7C, 65 inches for FIG. 7D, 80 inches for FIG. 7E, 52 inches for FIG. 7F, and 66 inches for FIG. 7G. Of course, the radii of the walls will vary depending upon the dimensions of the blocks. For example, larger radius walls can be formed by increasing the lengths of the faces of the blocks.

The angles of convergence of the side walls of each block in the three-block system are substantially the same. Thus, placing blocks of any size side-by-side in a course, with every other block being reversed 180°, forms a substantially straight wall. FIG. 8 illustrates a top plan view of one example of a wall formed by randomly placing small, medium and large blocks side-by-side with every other block being reversed so that the tapered side walls of each block is complemented by a side wall of an adjacent block to form a substantially straight wall.

Because the blocks of the three-block system have angled side walls, a corner block may be used to form a 90° corner at the end of a wall. FIG. 9 illustrates one example of a corner block 108. The corner block 108 includes a first face 110 and a second face 112, which extend perpendicularly to each other to form a 90° corner. The first and second faces 110, 112, respectively, typically are exposed faces, and as such, they may be provided with a roughened, or split, surface, to contribute to the natural appearance of the wall. A third face 114 is oriented at an obtuse angle 118 relative to the second face 112. A fourth face 116 is oriented at an acute angle 120 relative to the first face 110. Angles 118 and 120 of the corner block 108 are equal to the included angles 6 and 8, respectively, of the small, medium and large blocks to complement the tapered side wall of an adjacent block in a course. The corner block 108 also includes pin holes 26 in the upper surface and a generally L-shaped channel 115 in the lower surface.

Figure 10:
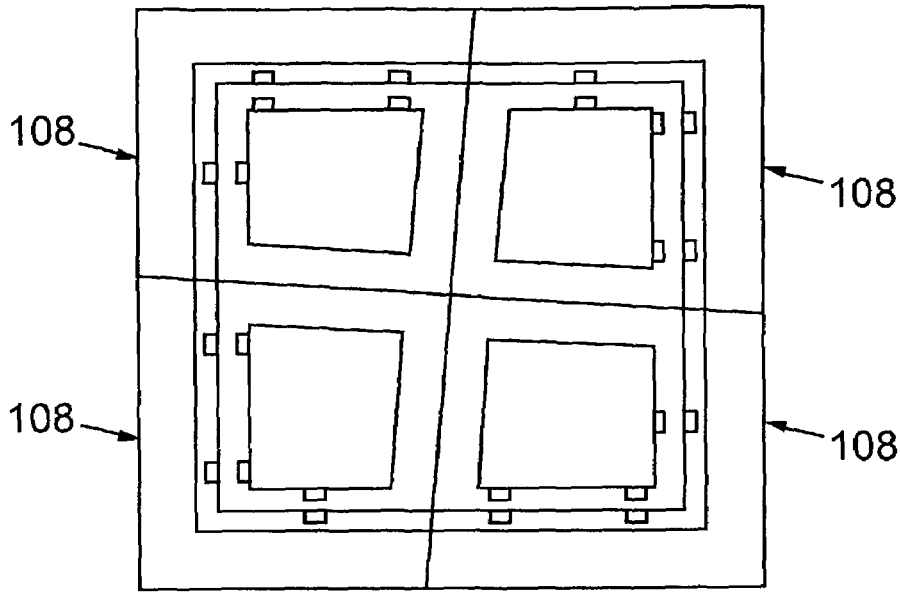
FIG. 10 is a top plan view of a pilaster formed from four of the corner blocks of FIG. 9.

FIG. 10 shows a pilaster (i.e., a column) that can be formed from four corner blocks 108. Such a pilaster can be used to reinforce or strengthen a wall and/or provide a more aesthetically pleasing wall.

Figure 11:
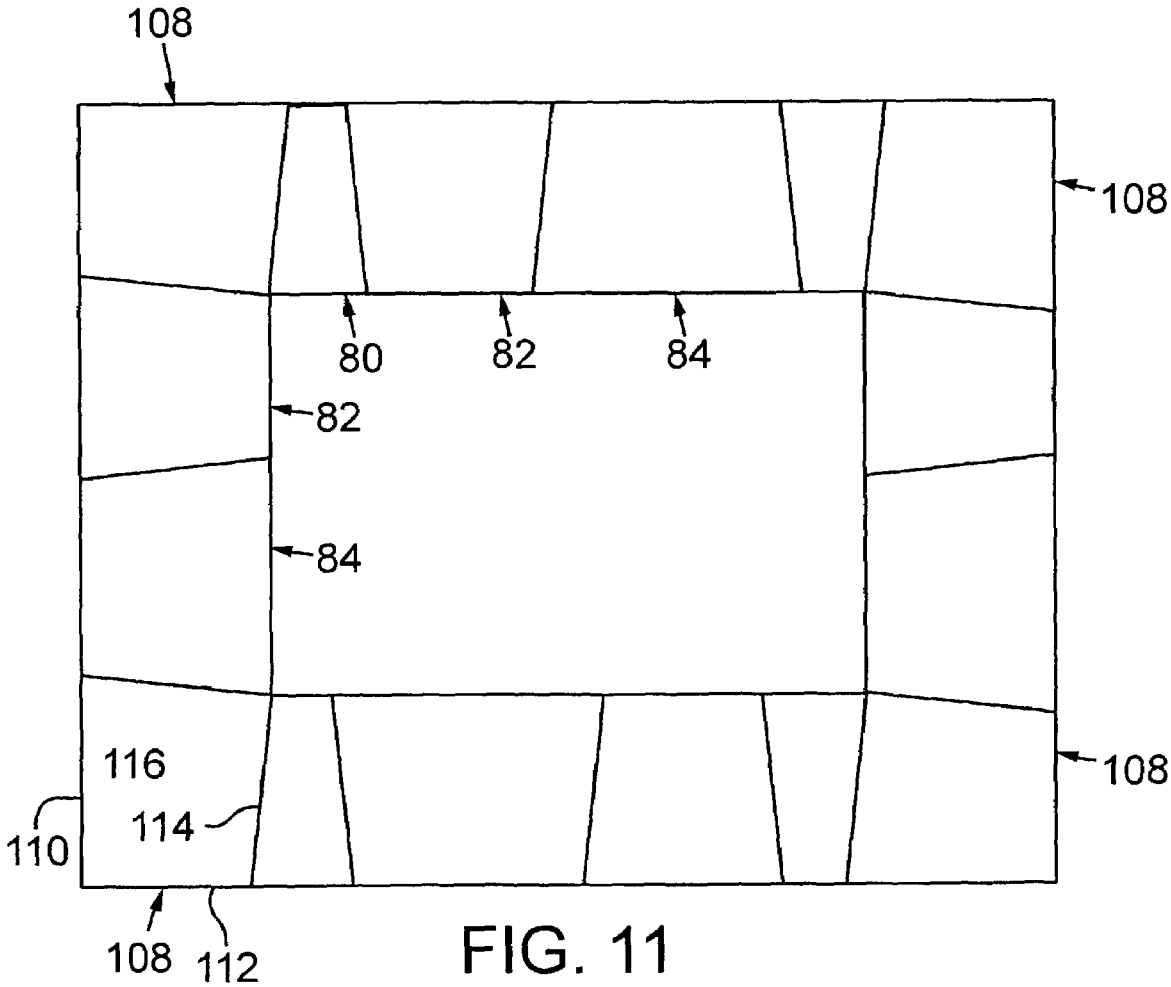
FIG. 11 is a top plan view of a rectangular wall enclosure constructed from the three-block system of FIG. 6.

FIG. 11 illustrates a top plan view of a rectangular enclosure constructed with the three-block system. Corner blocks 108 are positioned between the adjacent ends of the walls forming the enclosure.

Referring now to FIG. 12A-C, there is shown a block system according to another embodiment comprising a first and second set of blocks. The first set of blocks comprises a small block 150, a medium block 152 and a large block 154 and the second set of blocks comprises a small block 156, a medium block 158 and a large block 160. FIG. 12A illustrates a top plan view of both the large block 150 of the first set and the large block 156 of the second set. FIG. 12B illustrates a top plan view of both the medium block 152 of the first set and the medium block 158 of the second set. FIG. 12C illustrates a top plan view of the small block 154 of the first set and the small block 160 of the second set.

As shown in FIGS. 12A-C, the small, medium and large block of each set has the same general shape as the small, medium and large block shown in FIG. 6. In addition, the dimensions of the small block 150, medium block 152 and large block 154 of the first set are equal to the dimensions of the small block 156, medium block 158 and large block 160, respectively, of the second set, except that the blocks of the first set are greater in height than the blocks of the second set. Desirably, the height of the blocks of the first set is a multiple of the height of the blocks of the second set to permit the construction of a wall having a level or planar top surface. Within each set, the blocks have the same depth (i.e., the distance between the first face and the second face of a block) and height (i.e., the distance between the upper and lower surface of a block).

The large block 150 of the first set has a first face 124 and a second face 126. The large block 156 of the second set has a first face 136 and a second face 138. The length of the first face 124 of block 150 is equal to the length of the first face 136 of block 156. The medium block 152 of the first set has a first face 128 and a second face 130. The medium block 158 of the second set has a first face 140 and a second face 142. The first faces 128, 140 of the medium blocks 152, 158 are equal in length. The small block 154 of the first set has a first face 132 and a second face 134. The small block 160 of the second set has a first face 144 and a second face 146. The first faces 132, 144 of the small blocks 154, 160 are equal in length.

As shown, the first face of each block is greater in surface area than the second face so that each block can be used to provide at least two differently sized faces in the surface of a wall. Thus, a wall constructed from the small, medium and large blocks of both sets has the appearance of a wall constructed from twelve differently sized blocks. The angles of convergence of the side walls of each block are the same so that blocks placed side-by-side with every other block being reversed with respect to an adjacent block forms a substantially straight wall. Significantly, any two adjacent blocks form a closed joint at the front and back surface of the wall so that there are no open spaces between blocks. Thus, a wall made of blocks of the present embodiment can be used as a free-standing wall or fence.

FIG. 13 illustrates one example of a wall constructed from small, medium and large blocks of each set. In this illustration, the height of the blocks of the first set (blocks 150, 152 and 154) is twice the height of the blocks of the second set (blocks 156, 158 and 160). Thus, as shown in FIG. 13, the courses of a wall may comprise blocks of different heights so as to contribute to the random, natural appearance of the wall and a level upper surface of the wall can be achieved by selective stacking of the blocks. This also can be accomplished with any two sets of blocks in which the height of the blocks of one set is a multiple of the height of the blocks of another set. For example, the height of the blocks of the first set can be three times the height of the blocks of the second set.

The wall of FIG. 13 also includes blocks that are longitudinally offset with respect to blocks in an adjacent upper or lower course. For example, block 158*a* spans blocks 160*a* and 160*b* and part of block 160*c* in an adjacent lower course. Block 150*a* spans block 154*a* and block 154*b* and part of block 158*a* in an adjacent lower course and block 152*a* and part of block 152*b* in an adjacent upper course. Although not apparent in FIG. 13, the wall may include blocks that are vertically aligned over one another, set forward or set back.

In addition, any of the blocks of the first and second sets can be configured for use as a jumper block. FIG. 14, for example, shows both a large block 150*a* of the first set and large blocks 156*a* and 156*b* of the second set used as a jumper. The length of the first faces 124, 136 of blocks 150, 156, respectively, desirably is equal to the overall height of several horizontally oriented blocks stacked on top of each other. In this illustration, the length of the first faces 124, 136 is equal to the height of two horizontally stacked blocks of the first set or four horizontally stacked blocks of the second set.

In a specific implementation of the present embodiment, the first set of blocks comprises a small, medium and large block having a height of 8 inches. The first and second faces 124, 126, respectively, of the large block 150, are 16 and 14 inches, respectively, in length. The first and second faces 128, 130, respectively, of the medium block 152 are 12 and 10 inches, respectively, in length. The first and second faces 132, 134, respectively, of the small block 154 are 6 and 4 inches, respectively, in length. The depth of each block of the first set is 11.5 inches. A second set of blocks comprises a small, medium and large block having the same dimensions except that the blocks of the second set have a height of 4 inches.

Figure 15A:
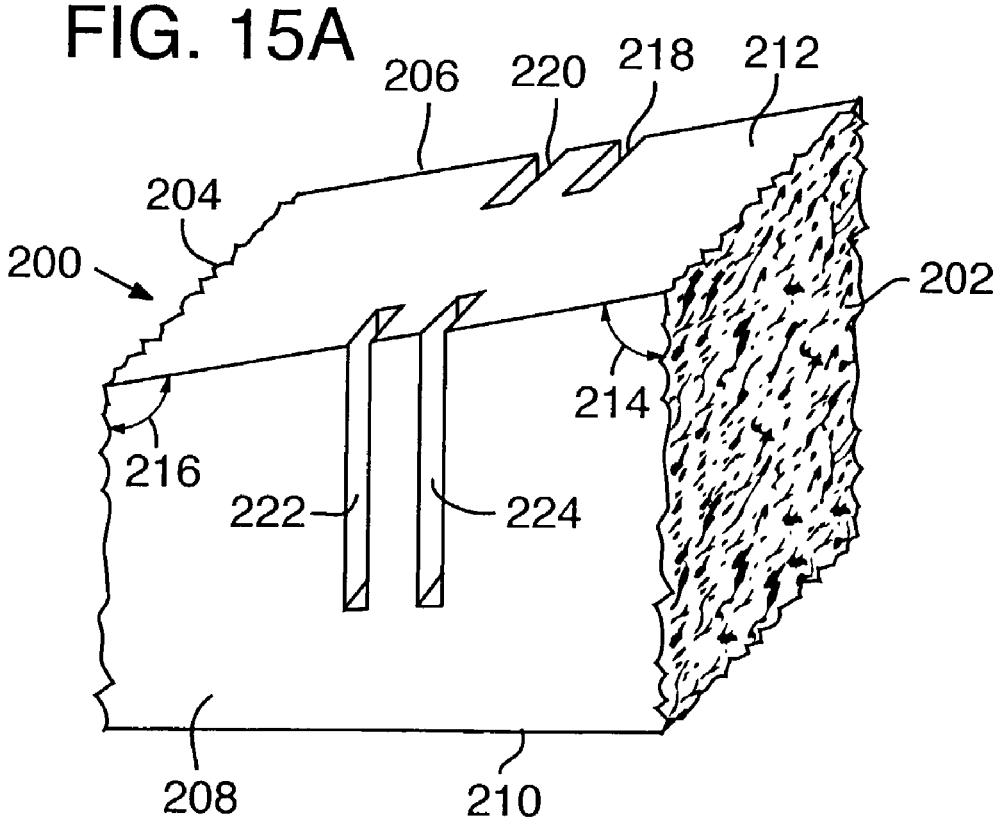
FIGS. 15A and 15B are perspective views of the same block according to another embodiment of my invention, as viewed from above, showing one side surface and the bottom surface in FIG. 15A, and the same side surface and the top surface in FIG. 15B.
Figure 15B:
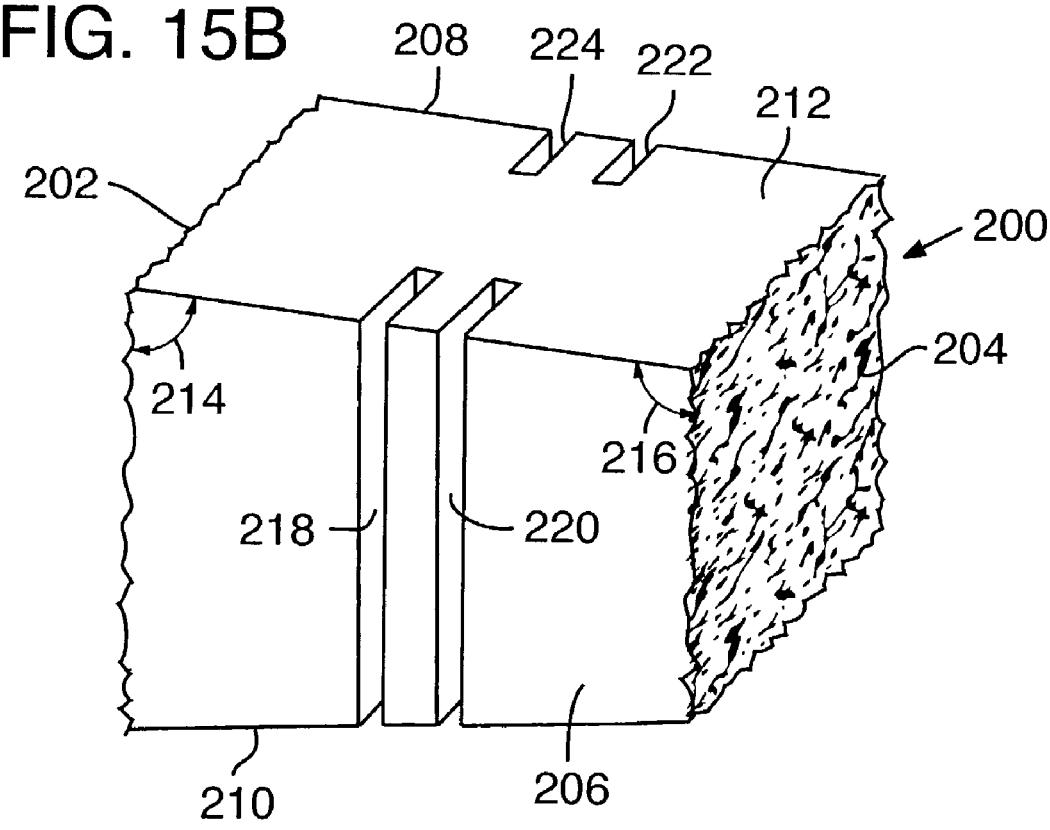

Referring now to FIGS. 15A, 15B and 16 there is shown a block 200 according to another representative embodiment. As shown, block 200 includes generally parallel first and second faces 202, 204, respectively, defining a block depth, and generally parallel top and bottom surfaces 206, 208, respectively, defining a block height. Side walls 210 and 212 extend between respective ends of the first and second faces 202, 204, respectively. Side wall 210 is perpendicular to the first face 202 and the second face 204. Side wall 212 tapers inwardly from the first face 202 to the second face 204 so as to form an acute angle 214 with the first face 202 and an obtuse angle 216 with the second face 204. Because of the tapered side wall 212, the surface area of the first face 202 is greater than the surface area of the second face 204. Both the first face 202 and the second face 204 may have a split or roughened surface. Block 200 is reversible so that either the first face 202 or the second face 204 can be positioned in a surface of a wall.

The top surface 206 includes longitudinally extending channels 218 and 220 extending substantially parallel to the first and second faces 202, 204, respectively (FIG. 15B). Channels 218, 220 extend continuously between the side walls 210 and 212, that is, channels 218, 220 extend completely across the block to intersect the opposite side walls. The bottom surface 208 of the block 200 includes longitudinally extending channels 222 and 224, which also extend substantially parallel to the first face 202 and the second face 204 (FIGS. 15A and 16). Channels 222 and 224 intersect the tapered side wall 212 but extend only partially across the block, terminating short of side wall 210.

Channels 218 and 220 serve the purpose of pin receiving apertures, the same as pin holes 26 of block 10 in FIGS. 1 and 2. Thus, to interconnect blocks of adjacent courses, the lower portion of a pin 32 may be inserted into either of channels 218 or 220 in the top surface 206 of a lower block. Desirably, the widths of channels 218 and 220 are dimensioned to form a slight frictional fit with a pin 32. The head of the pin is then received in either of slots 222 or 224 in the bottom surface 208 of an overlying block.

The sections of concrete between channels 222 and 224 and between channels 220 and 218 may be recessed slightly (e.g., about ⅛ inch) relative to the top and bottom surfaces to avoid damage to those sections when the block is tumbled.

Like block 10 of FIGS. 1 and 2, block 200 of the present embodiment permits alignment of blocks directly over one another, set forward, or set backward relative to one another so that either vertical or non-vertical walls may be constructed. Block 200 can also be turned on its side and used as a jumper. When used in this manner, the top and bottom surfaces serve as the side walls of the block in a wall and the side walls serve as either the top or bottom of the block in a wall.

In another embodiment, channels 218 and 220 are formed in the bottom surface of the block and channels 222 and 224 are formed in the top surface of the block. In yet another embodiment, a single channel is formed in each of the bottom and top surfaces. In the latter configuration, the channels desirably are equidistant from the first and second faces 202, 204 to permit the construction of vertical walls.

FIG. 17 illustrates a plan view of the bottom of a block 250 according to another embodiment. Block 250 is similar to block 200 of FIGS. 15A, 15B and 16 in all respects except that block 250 has non-parallel first and second faces 252, 254, respectively. The first face 252 is angled slightly so that it forms an acute angle 260 with side surface 256. Similarly, the second face 254 is oriented to form an acute angle 262 with side surface 256. Side surface 258 form an acute angle 264 with the first face 252 that is slightly less than angle 214 of block 200 and an obtuse angle 266 that is slightly greater than angle 216 of block 200.

Block 250 is desirable in that angled first and second faces 202, 204, respectively, provide for a substantially non-planar wall surface, thereby enhancing the natural appearance of the wall.

Figure 18:
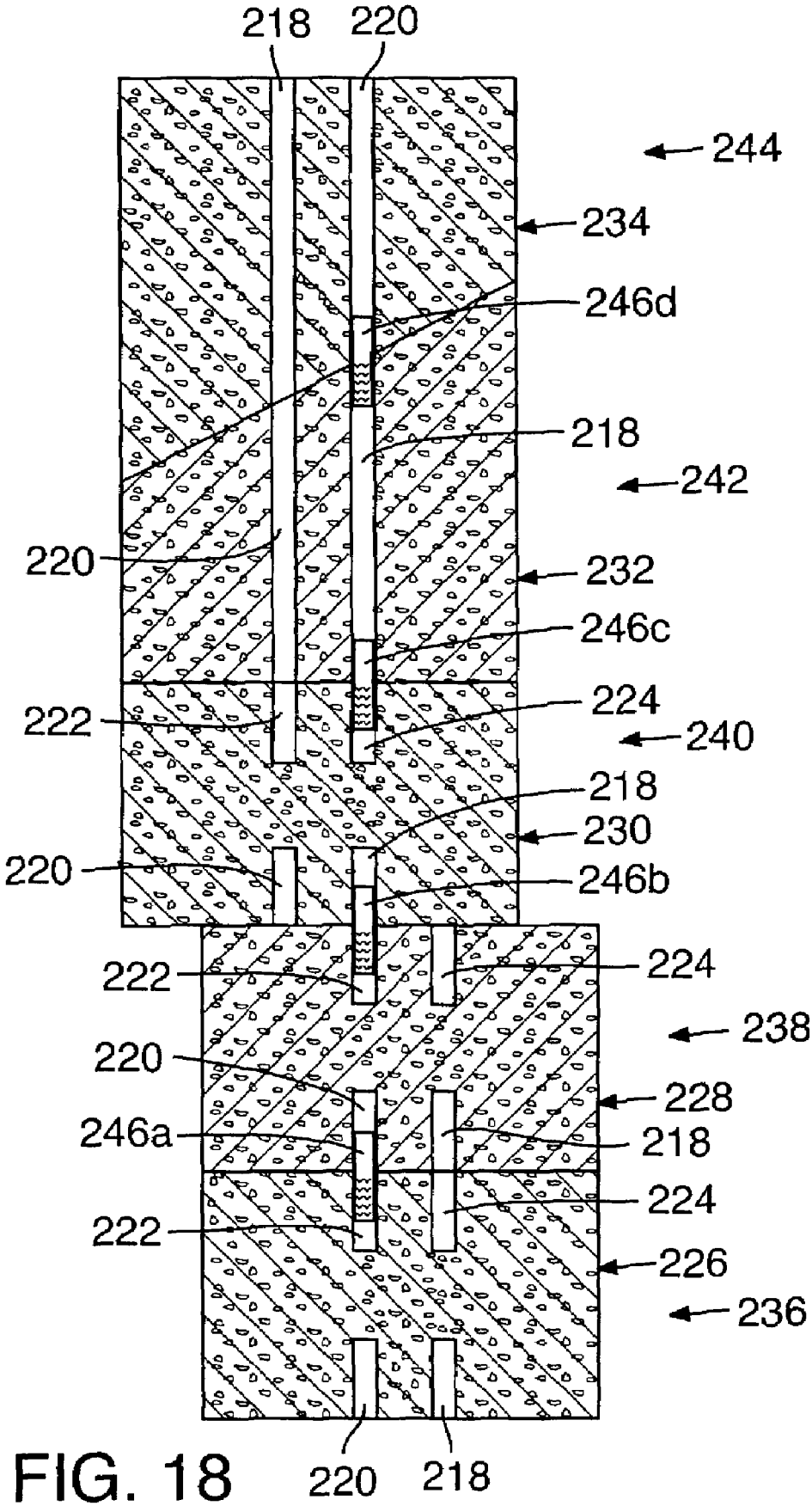
FIG. 18 is a vertical sectional view, from front to back, of a wall constructed from blocks all having the configuration of the block shown in FIGS. 15A, 15B and 16.

FIG. 18 shows a sectional, side elevational view of a wall constructed from a plurality of blocks which may have the same general shape of block 200 of FIGS. 15A, 15B and 16 or block 250 of FIG. 17. Block 228 of the second course 238 is vertically aligned over block 226 of the first course 236. A pin 246*a* is partially received in channel 220 of block 226 and channel 222 of block 228. Although not shown in FIG. 18, block 228 may be shifted sideways in the second course 238 so as to span lower block 226 and another adjacent lower block in the first course 236. Block 230 of the third course 240 is set back from block 228 of the second course 238. A pin 246*b* is partially received in channel 220 of block 228 and channel 224 of block 230. Block 232 of the fourth course 242 is turned as a jumper block, with the non-tapered side wall 210 serving as the bottom of the block and the tapered side wall 212 serving as the top of the block. A pin 246*c* is partially received in channel 218 of block 230 and the end of channel 218 of block 232. To form a level, uppermost fifth course 244, block 234 is stacked on top of block 232 with the tapered side wall 212 of block 234 supported on the tapered side wall 212 of block 232. A pin 246*d* is partially received in channel 218 of block 232 and channel 220 of block 234 to interconnect blocks 232 and 234.

FIG. 20 illustrates a perspective view of a block 270 according to another embodiment. Block 270 is similar to block 200 of FIGS. 15A and 15B in all respects except that block 270 has a single channel 272 formed in the top surface 206 and spaced equidistantly from the first and second faces 202, 204. In addition, the spacing between channels 222 and 224 in the bottom surface 208 is greater in block 270 than in block 200 to minimize damage to the section of concrete between channels 222 and 224 if the block is tumbled. Block 270 can be positioned in a set forward or set backward relationship relative to a vertically adjacent block in a wall.

Figure 19:
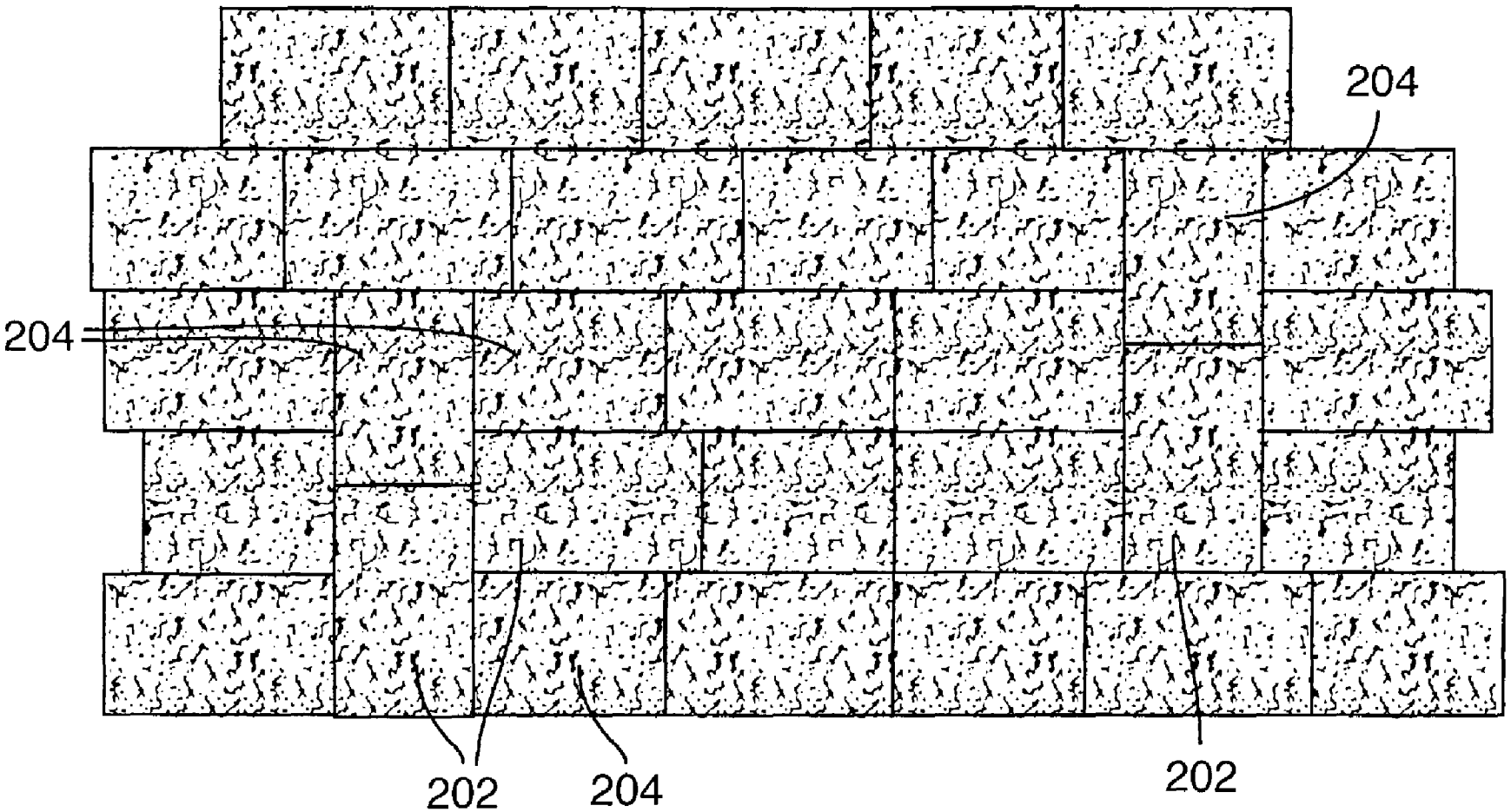
FIG. 19 is a front elevational view of a wall constructed from blocks all having the configuration of the block shown in FIG. 16.

FIG. 19 shows a front elevational view of a wall constructed from a plurality of blocks 200, although blocks having the same shape as block 250 of FIG. 17 or block 270 of FIG. 20 also may be used. As shown, block 200 may be positioned in either a horizontal orientation or a vertical orientation. Two blocks stacked in a vertical direction span a vertical distance equal to the total length of the first face 202 and the, second face 204, which desirably is equal to the overall height of multiple blocks stacked in a horizontal orientation. In the present embodiment, for example, two blocks stacked in a vertical orientation span a vertical distance equal to the height of three horizontally stacked blocks.

The dimensions of block 200 may vary. In one specific embodiment, the depth of the block between the first and second face is about 8 inches. The height of the block between the upper and lower surfaces is 4.875 inches. The lengths of the first face and the second face are 8 inches and 6.5 inches, respectively.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

I claim:

1. A block for constructing walls, comprising:

an upper surface spaced apart from a lower surface, thereby defining a block height;

opposed first and second faces, wherein the first face has a surface area greater than that of the second face;

opposed side surfaces extending between respective ends of the first and second faces, the block defining a width extending from one side surface to the other side surface;

first, second, third, and fourth rows of at least two spaced apart rectangular pin holes formed in the upper surface, each row of pin holes extending in the direction of the block width, wherein the first and second rows of pin holes are on opposing sides of a longitudinal axis bisecting the upper surface and spaced a first distance from the longitudinal axis, and the third and fourth rows of pin holes are on opposing sides of the longitudinal axis and spaced a second distance from the longitudinal axis, the second distance being less than the first distance, each pin hole having a width extending perpendicular to the longitudinal axis bisecting the upper surface and being spaced inwardly and away from the side surfaces of the block;

a first longitudinally extending pin-receiving channel formed in the lower surface; and a second longitudinally extending pin-receiving channel formed in the lower surface and extending parallel to the first pin-receiving channel, the first and second pin-receiving channels being on opposite sides of a longitudinal axis bisecting the lower surface, each channel having first and second opposing side surfaces extending parallel to the longitudinal axis bisecting the lower surface and a width extending perpendicular to the longitudinal axis bisecting the lower surface;

wherein the pin holes of the first row of pin holes are positioned between respective vertical planes defined by the opposing side surfaces of the first channel and the pin holes of the second row of pin holes are positioned between respective vertical planes defined by the opposing side surfaces of the second channel;

wherein the pin holes of the third row of pin holes are positioned on the same side of the longitudinal axis bisecting the upper surface as the pin holes of the first row and are spaced inwardly from the first channel; and wherein the pin holes of the fourth row of pin holes face the pin holes of the third row of pin holes, the pin holes of the fourth row being positioned on the same side of the longitudinal axis bisecting the upper surface as the pin holes of the second row and being spaced inwardly from the second channel; wherein the pin holes of the first row of pin holes are positioned between the vertical planes defined by the opposing side surfaces of the first channel such that a side surface of each pin hole of the first row is vertically aligned with the first side surface of the first channel, the width of the first channel being greater than the width of the pin holes of the first row; and the pin holes of the second row of pin holes are positioned between the vertical planes defined by the opposing side surfaces of the second channel such that a side surface of each pin hole of the second row is vertically aligned with the first side surface of the second channel, the width of the second channel being greater than the width of the pin holes of the second row.

2. The block of claim 1, wherein the first face and the second face have roughened surfaces resembling natural stone to permit either face to be used in the exposed surface of a wall.

3. The block of claim 2, wherein the side surfaces converge from the first face to the second face so as to define respective acute angles between the side surfaces and the first face and respective obtuse angles between the side surfaces and the second face.

4. The block of claim 1, wherein one of said side surfaces is substantially perpendicular to the first and second faces.

5. The block of claim 1, further comprising first and second hand holds recessed in the lower surface and intersecting respective side surfaces but not the upper surface of the block.

6. The block of claim 1, wherein the first and second channels extend through the side surfaces of the block.

7. The block of claim 1, further comprising a core formed in the lower surface of the block between the first and second channels.

8. A wall having a front surface and a rear surface, the wall comprising:

at least a first lower course and a second upper course, each course comprising a plurality of blocks of the type claimed in claim 1;

the blocks being positioned in the first and second courses such that the front surface of the wall comprises the first faces of a plurality of blocks and second faces of a plurality of blocks to thereby provide an irregular block pattern; and a plurality of pins, each pin comprising an upper portion and a lower portion, the upper portion having a diameter that is no greater than that of the lower portion and the width of the pin holes, the lower portion of each pin being secured in a pin hole of a block in the first course and the upper portion of each pin extending into a channel of a block in the second course.

9. The wall of claim 8, wherein the first faces and second faces of the blocks have roughened surface textures to give the appearance of natural stone.

10. The wall of claim 9, wherein the side surfaces of each block converge from the first face to the second face.

11. The wall of claim 9, wherein each block of the first and second courses has one side surface that is substantially perpendicular to its respective first and second faces.

12. The wall of claim 8, wherein the first face of each block of the first and second courses has a length extending between its respective side surfaces, the length being evenly divisible by the height of the block.

13. A method of constructing a wall from blocks, the method comprising:

providing a first block according to claim 1, wherein the first face of the first block has a surface area greater than its second face and the side surfaces of the first block are non-parallel to each other;

positioning the first block in a first course in a horizontal position with the its lower surface facing the ground;

providing a second block according to claim 1, wherein the first face of the second block has a surface area greater than its second face and the side surfaces of the second block are non-parallel to each other; and positioning the second block in a second course on top of the first course in a vertical position so that the first side surface of the second block is supported on and facing the upper surface of the first block.

14. The method of claim 13, wherein the side surfaces of the second block converge from the first face to the second face and wherein positioning the second block in the second course further comprises inserting a pin into one of the side surfaces of the second block to support the second block in a vertically upright position.

15. The method of claim 13, wherein the one of the side surfaces of the second block is perpendicular to the first and second faces of the second block and the side surfaces of the second block converge in a direction from the first face to the second face of the second block.

16. The method of claim 13, further comprising:

positioning additional blocks in the second course such that each block is in a horizontal position with a lower surface of the block facing the ground; and positioning additional blocks in a third course on top of the additional blocks of the second course, with each additional block in the third course positioned in a horizontal position with a lower surface facing the ground;

wherein the second block spans the height of the additional blocks in the second and third courses in a vertical direction.

17. The method of claim 16, wherein the first face of the second block has a length that is a multiple of and greater than the height of the additional blocks of the second and third courses, wherein the multiple is the product of the height of the additional blocks and an integer.

18. The block of claim 1, wherein the first face has a length extending from one of the side surfaces to the other side surface, the length being a multiple of the height of the block, wherein the multiple is the product of the block height and an integer, and the length is greater than the height.

19. The block of claim 1, wherein the opening is generally rectangular and is elongated in a direction extending from one of the side surfaces of the block to the other side surface of the block.

20. A wall block system for use in constructing a wall from multiple course of wall blocks stacked on top of each other, the wall block system comprising:

a plurality of wall blocks of the type claimed in claim 1, wherein the width of the channels are greater than the width of the pin holes;

and a plurality of pins, each pin comprising an upper portion and a lower portion, the upper portion having a diameter that is no greater than that of the lower portion and the width of the pin holes, the lower portion of each pin being sized to be received in a pin hole, the upper portion being sized to be received in a channel, the pins being configured such that when the wall is constructed from the wall block system, the lower portion is configured to be received within a pin hole in the upper surface of a block in a first course and the upper portion is configured to be received in a channel in the lower surface of a block in a second course stacked on top of the first course.

21. The wall block system of claim 20, wherein:

the pins are configured such that the lower portion of each pin frictionally engages a pin hole of a block in the first course; and the upper portion of each pin is sized such that when it is inserted into the channel of a block, there is spacing between the upper portion and a surface of the channel in the direction of the width of the channel.

22. The wall block system of claim 20, wherein the first face of each block has a surface area greater than that of the second face and the blocks are configured to be positioned in the first and second courses such that a front surface of the wall comprises the first faces of a plurality of the blocks and the second faces of a plurality of the blocks to thereby provide an irregular block pattern.

23. A block for constructing walls, comprising:

an upper surface spaced apart from a lower surface, thereby defining a block height;

opposed first and second faces, both faces having a roughened surface texture resembling natural stone to permit either face to be used in the exposed surface of a wall;

opposed side surfaces extending between respective ends of the first and second faces, the block defining a width extending from one side surface to the other side surface;

at least first, second, third, and fourth rows of rectangular pin-receiving apertures formed in the upper surface, each row of apertures extending in the direction of the block width, wherein the first and second rows are on opposing sides of a vertical plane bisecting the block and extending in the direction of the block width, and the third and fourth rows are on opposing sides of the vertical plane and are closer to the vertical plane than the first and second rows, and wherein each aperture is spaced inwardly and away from the side surfaces of the block; and first and second longitudinally extending pin-receiving channels formed in the lower surface and positioned on opposite sides of the vertical plane, the first and second channels extending at least partially between the side surfaces;

wherein each pin-receiving aperture in the upper surface has first and second, opposing side surfaces and each channel has first and second, opposing side surfaces, the pin-receiving apertures of the first row being positioned between respective vertical planes defined by the first and second side surfaces of the first channel such that the first side surface of each pin-receiving aperture of the first row is vertically aligned with the vertical plane defined by the first side surface of the first channel and the second side surface of each pin-receiving aperture of the first row is spaced from the vertical plane defined by the second side surface of the first channel, the pin-receiving apertures of the second row being positioned between respective vertical planes defined by the first and second side surfaces of the second channel such that the first side surface of each pin-receiving aperture of the second row is vertically aligned with the vertical plane defined by the first side surface of the second channel and the second side surface of each pin-receiving aperture of the second row is spaced from the vertical plane defined by the second side surface of the second channel, wherein the pin-receiving apertures of the third row are positioned on the same side of the vertical plane bisecting the block as the pin-receiving apertures of the first row and are spaced inwardly and away from the first channel, wherein the pin-receiving apertures of the fourth row face the pin-receiving apertures of the third row, the pin-receiving apertures of the fourth row being positioned on the same side of the vertical plane bisecting the block as the pin-receiving apertures of the second row and are spaced inwardly and away from the second channel.

* * * * *